US008132955B2

(12) United States Patent
Fan

(10) Patent No.: US 8,132,955 B2
(45) Date of Patent: Mar. 13, 2012

(54) LAMP BODY USED IN THE LED LIGHT STRING

(75) Inventor: Ben Fan, Heshan (CN)

(73) Assignee: He Shan Lide Electronic Enterprise Company Ltd. (CN)

( * ) Notice: Subject to any disclaimer, the term of this patent is extended or adjusted under 35 U.S.C. 154(b) by 450 days.

(21) Appl. No.: 11/940,839

(22) Filed: Nov. 15, 2007

(65) Prior Publication Data

US 2009/0129099 A1 May 21, 2009

(51) Int. Cl.
*H01R 33/00* (2006.01)

(52) U.S. Cl. ..... 362/645; 362/652; 362/267; 362/391

(58) Field of Classification Search ..... 362/647, 362/652–659, 267, 363, 255, 249.01, 249.02, 362/391, 31, 806, 310, 64, 800; 439/619, 439/699.2; 257/98–100, E33.056
See application file for complete search history.

(56) References Cited

U.S. PATENT DOCUMENTS

| | | | | |
|---|---|---|---|---|
| 5,856,777 | A * | 1/1999 | Rullman et al. | 340/426.22 |
| 6,123,433 | A * | 9/2000 | Chen | 362/654 |
| 7,161,189 | B2 * | 1/2007 | Wu | 257/98 |
| 7,241,032 | B2 * | 7/2007 | Qingbiao | 362/382 |
| 7,270,568 | B2 * | 9/2007 | Osypka | 439/502 |
| 7,387,403 | B2 * | 6/2008 | Mighetto | 362/218 |
| 7,470,935 | B2 * | 12/2008 | Lee et al. | 257/98 |
| 2007/0183153 | A1 * | 8/2007 | Yu | 362/252 |
| 2009/0020770 | A1 * | 1/2009 | Wang et al. | 257/91 |

* cited by examiner

*Primary Examiner* — Thomas Sember
(74) *Attorney, Agent, or Firm* — Seyfarth Shaw LLP

(57) ABSTRACT

A lamp body used in a LED light string comprises: a light-emitting chip which is installed on the frame, a package colloid which is provided to cover the top of the frame, wherein a lamp holder which covers the two leads and a part of the wires is provided beneath the package colloid and forms an integral unit with the package colloid, two leads and wires, so that it is capable of eliminating the potential problem as water inleakage at the joint of the package colloid and the lamp holder, and the waterproof ability is greatly improved. Meanwhile, the process of assembling the package colloid to the lamp holder by hand can be cancelled, so that mass production by machine can be realized efficiently.

17 Claims, 7 Drawing Sheets

LAMP BODY USED IN THE LED LIGHT STRING

BACKGROUND OF THE INVENTION

The present invention relates to a decorative light string, and in particular to a lamp body used in a LED light string.

The decorative light string is a kind of decorative lighting in which a plurality of bulbs are connected in series or in parallel for using in some decorative occasions. Such kind of light string is commonly installed outdoors, so that the waterproof protection and electrical connection reliability is especially important. In the prior art, the conventional way to assure the waterproof reliability and safety of electrical connection is that, as shown in FIG. 1, a lamp body used in the light string has two main components, i.e. the bulb 01 and the lamp holder 03. Two spring pads 04 are embedded symmetrically in lamp holder 03 and connected respectively to electrical wire 05; a soft socket 02 is provided to cover the bottom of bulb 01, two leads of bulb 01 are elicited from the bottom of the soft socket 02, the bottom of bulb 01 which is covered by the soft socket 02 is inserted into lamp holder 03, the two leads of bulb 01 are electrically attached to two spring pads 04, a folding border 021 is provided on the top of the soft socket 02 to cover the recess of lamp holder 03 to resist water, the exterior wall of the soft socket 02 is attached closely to lamp holder 03 to achieve the secondary waterproof protection. However, the folding border 021 can not resist water completely and thoroughly. Moreover, for the reason of manufacturing process, it is impossible to assemble the soft socket 02 with the lamp holder 03 to the extent that no clearance exists, so that the inleakage of rain or water may occur and cause the short circuit of the bulb. Especially, after long-term use of the light string, the aging of the soft socket 02 and the lamp holder 03 may result in poor property of this waterproof design. Furthermore, the electrical connection of this light string is not reliable enough because the electrical contact of two leads of bulb 01 is realized by the elastic pressure of the spring pads, so that they are easily dislocated when swinging in the wind. Moreover, the lamp body consists of many parts, so that the cost of manufacture and maintenance is comparatively high.

SUMMARY OF THE INVENTION

Therefore, the object of the present invention is to provide a lamp body used in a Christmas LED light string with better waterproof effect and simpler structure.

The above-mentioned object can be achieved by the following technical solution:

a lamp body, comprises:

a LED light-emitting chip, a frame and a lamp holder, wherein the light-emitting chip is installed on the frame, the upper portion of frame is covered by a package colloid, two leads of the frame are elicited downwards from the bottom of the package colloid; an insulating lamina is provided between the two leads; a lamp holder is provided beneath the package colloid, the lamp holder covers the two leads and part of wires, and the package colloid, the leads and the wires are formed as an integral unit.

Comparing with the prior art, the advantages of the present invention are:

The light-emitting chip is installed on the frame, a package colloid is provide to cover the upper portion of the frame, a lamp holder which covers the two leads and part of the wires is provided beneath the package colloid and forms an integral unit with the package colloid, the leads and wires, so that it is capable of eliminating the potential problem of water inleakage at the joint between the package colloid and the lamp holder, and the waterproof ability is greatly improved. Meanwhile, the process of assembling the package colloid to the lamp holder by hand is cancelled, so that mass production by machine can be realized efficiently.

Moreover, the present invention can be further improved by the following technical solution:

A connecting part is formed at the bottom of the package colloid, wherein the connecting part for better connection between the lamp holder and the package colloid is inserted into the lamp holder integrally.

The connecting part is provided with a groove, thus, in the connection between the lamp holder and the connecting part, a portion of the lamp holder is clasped with the grooves so that the connection is more stable.

The groove extends circumferentially around the connecting part, thus the area of the groove becomes larger and more material of the lamp holder clasps with the groove, the reliability of connection of the lamp holder and the connecting part is further improved accordingly.

Grooves or protrusions are provided on the outer surface of the package colloid to scatter the light, so that the light becomes softer.

The grooves or protrusions on the outer surface of the package colloid are arranged regularly, therefore the light will be dispersed more uniformly.

A heat-shrinkable tube is provided to cover the electrical connection of the wires and the two leads so as to avoid a part of wires and leads exposing outside the lamp holder during the injection process of the lamp holder when the mold is installed improperly such as displacement.

BRIEF DESCRIPTION OF THE DRAWINGS

Hereinafter is the further description of the present invention accompanying with the drawings and embodiments.

DETAILED DESCRIPTION OF THE INVENTION

Figure 1:
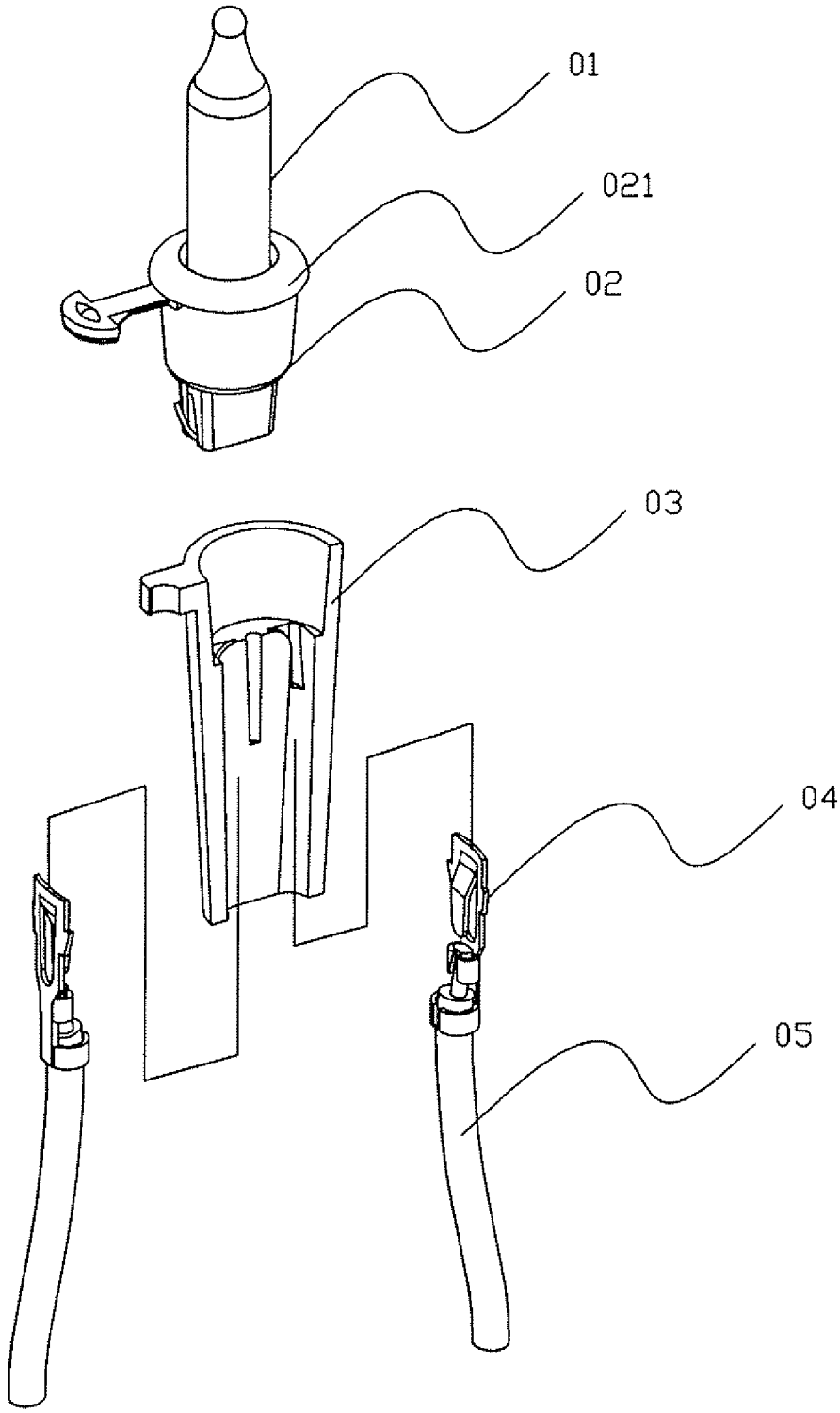
FIG. 1 is the schematic view of the structure of the known LED lamp body in the prior art.
Figure 2:
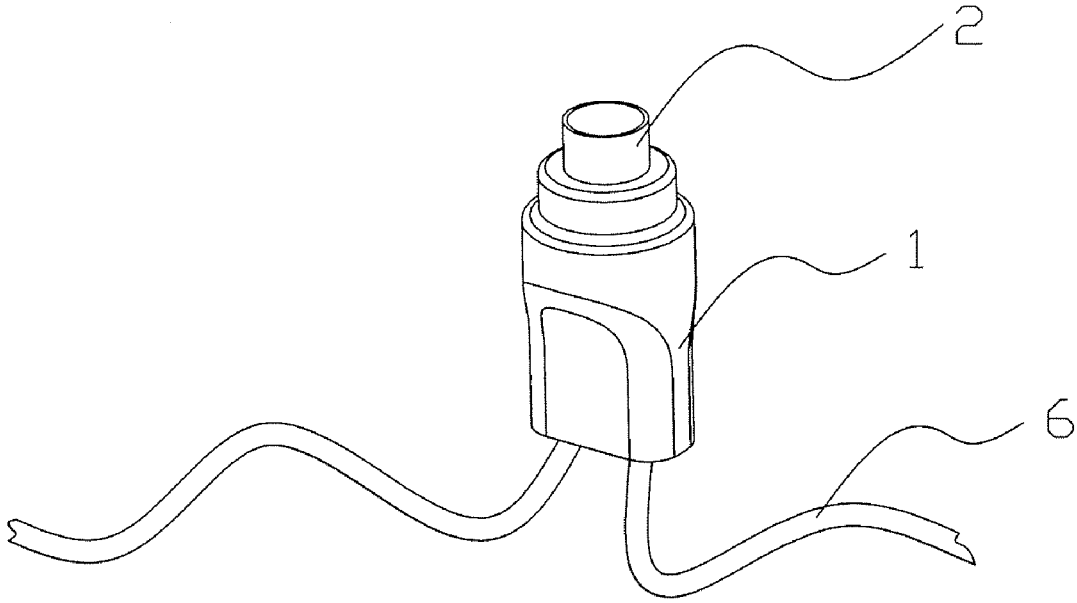
FIG. 2 is a first schematic view of the exterior structure of the present invention.
Figure 3:
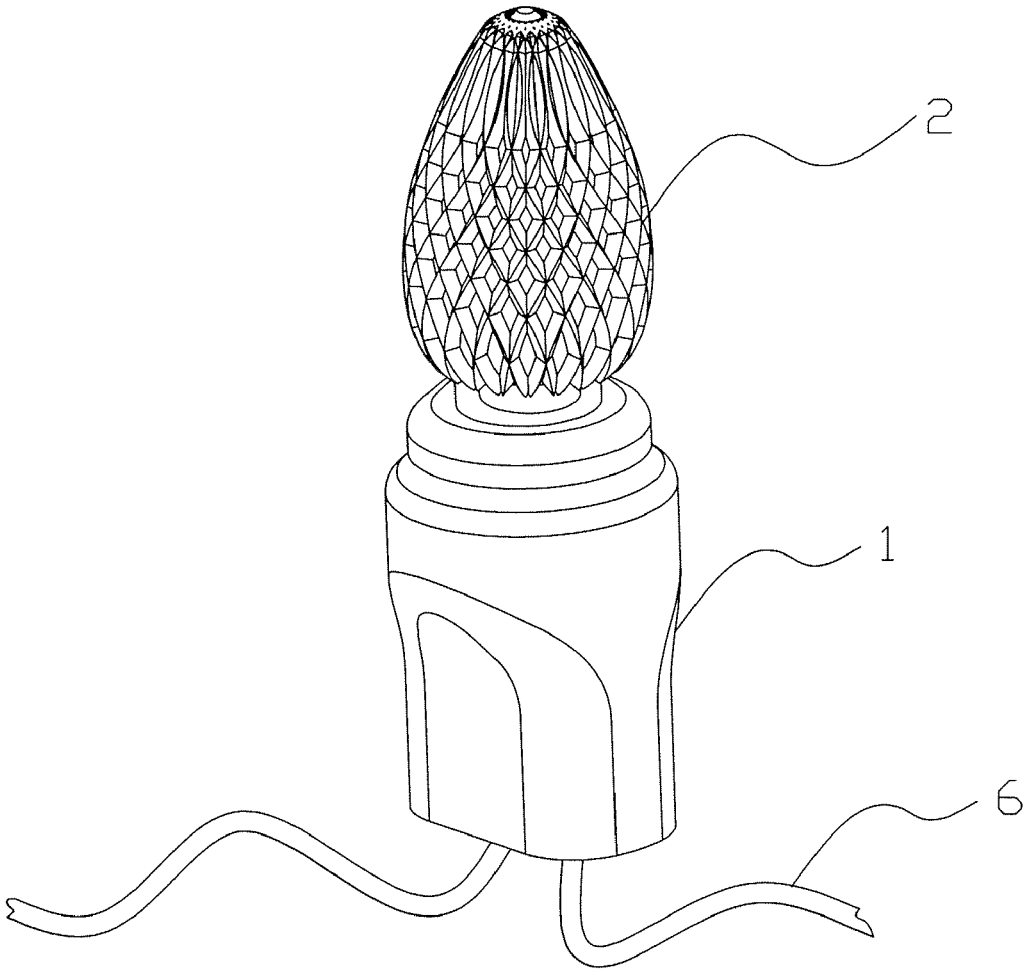
FIG. 3 is a second schematic view of the exterior structure of the present invention.
Figure 4:
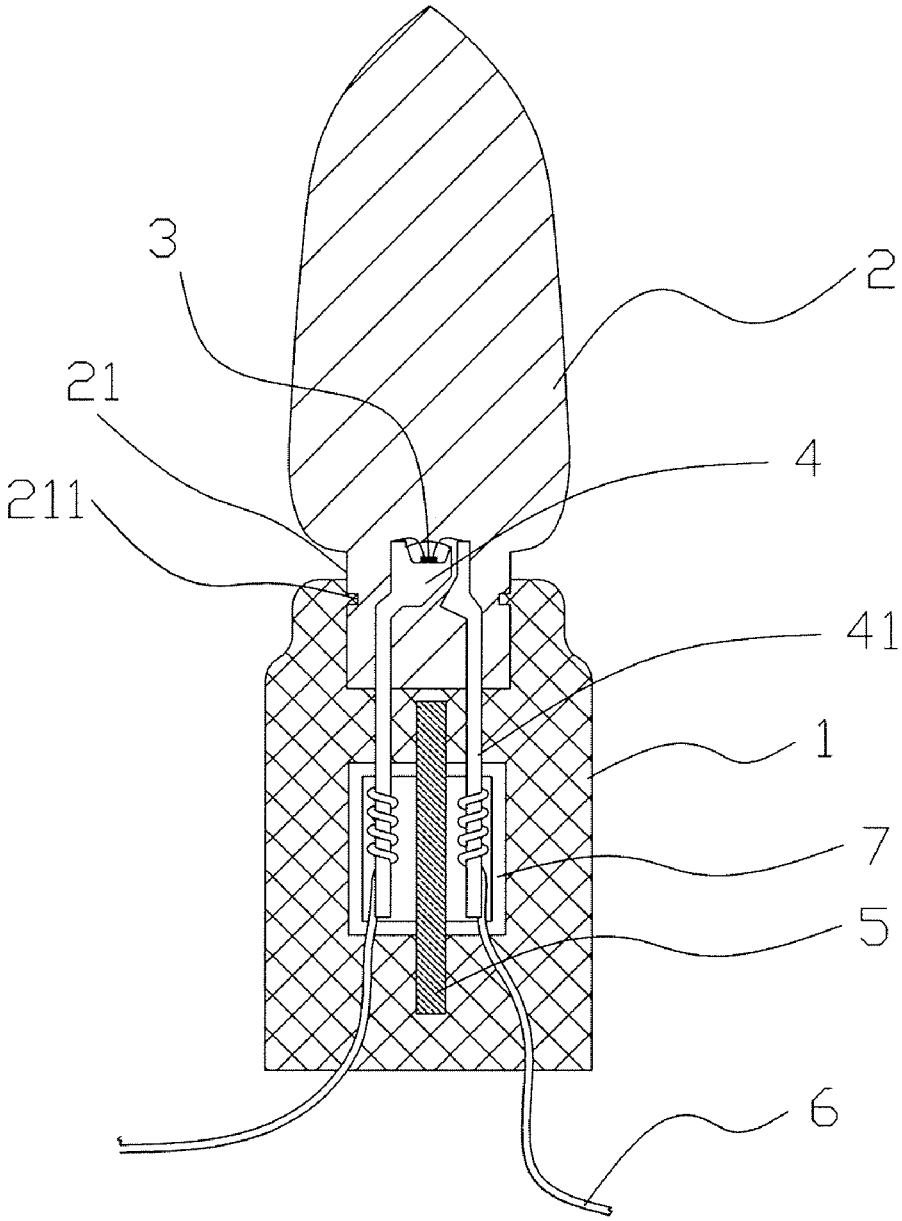
FIG. 4 is the sectional view of the present invention.
Figure 5:
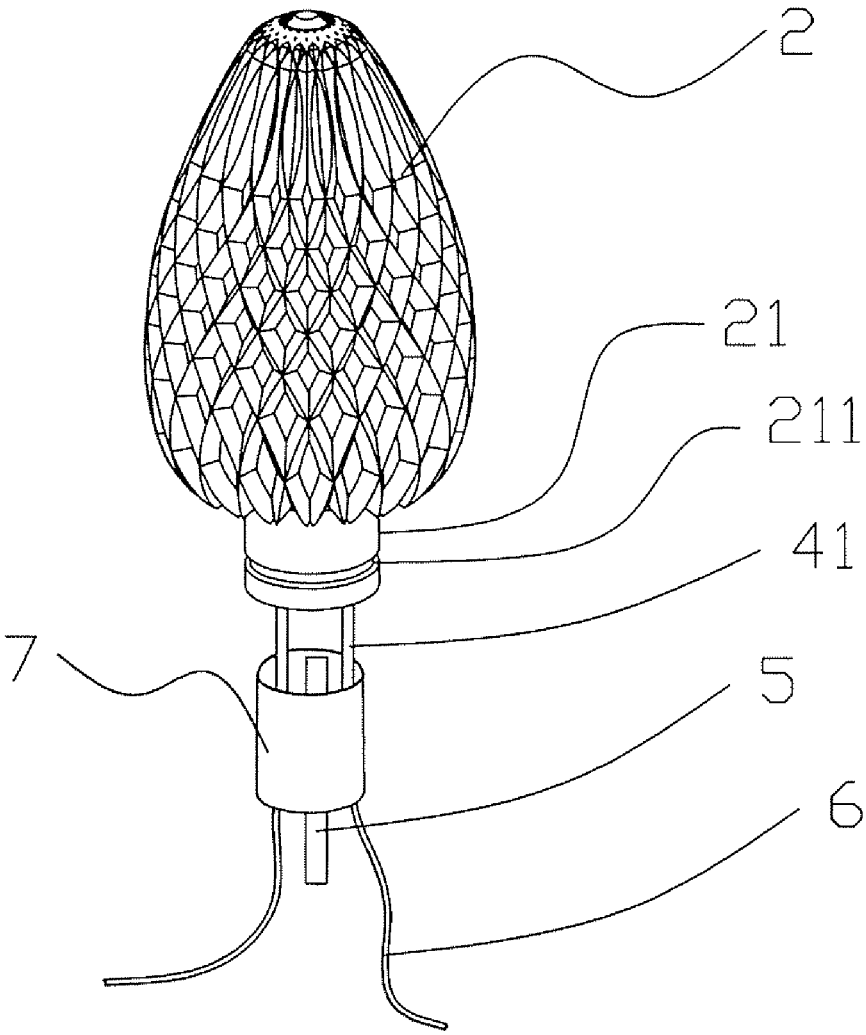
FIG. 5 is the schematic view of the structure of the package colloid of the present invention.
Figure 6:
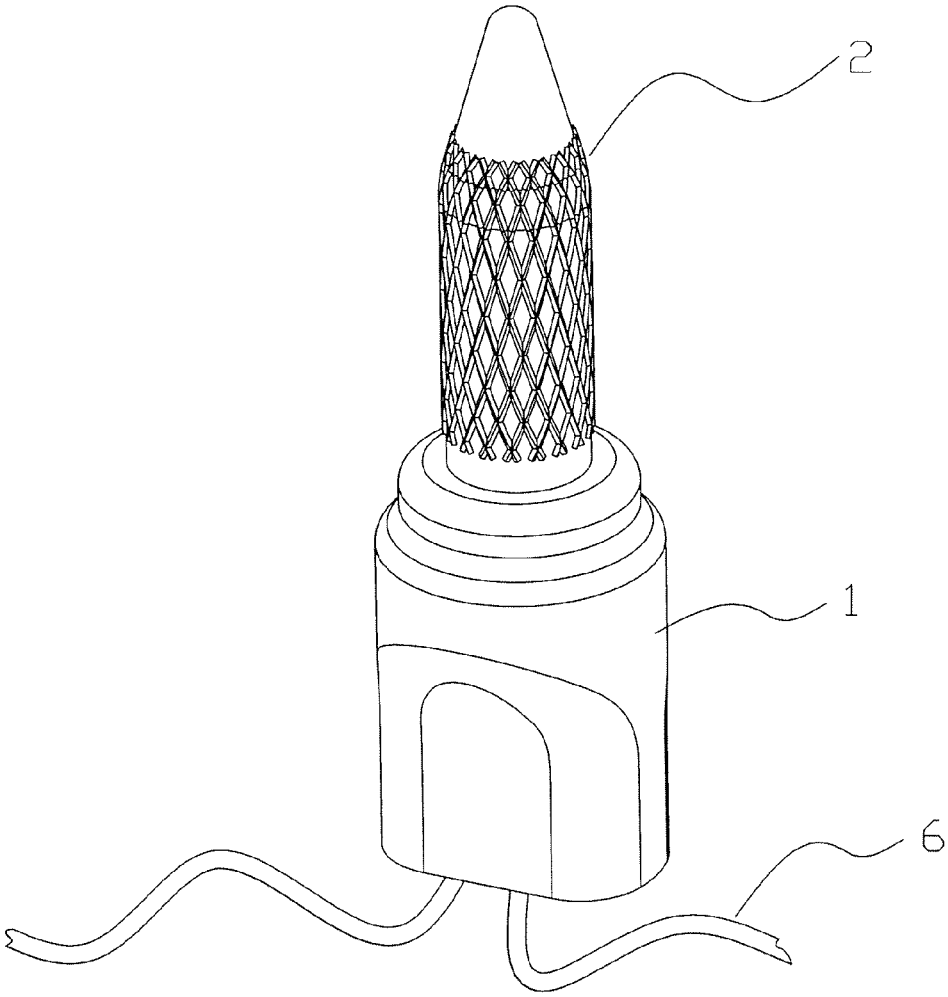
FIG. 6 is a third schematic view of the exterior structure of the present invention.
Figure 7:
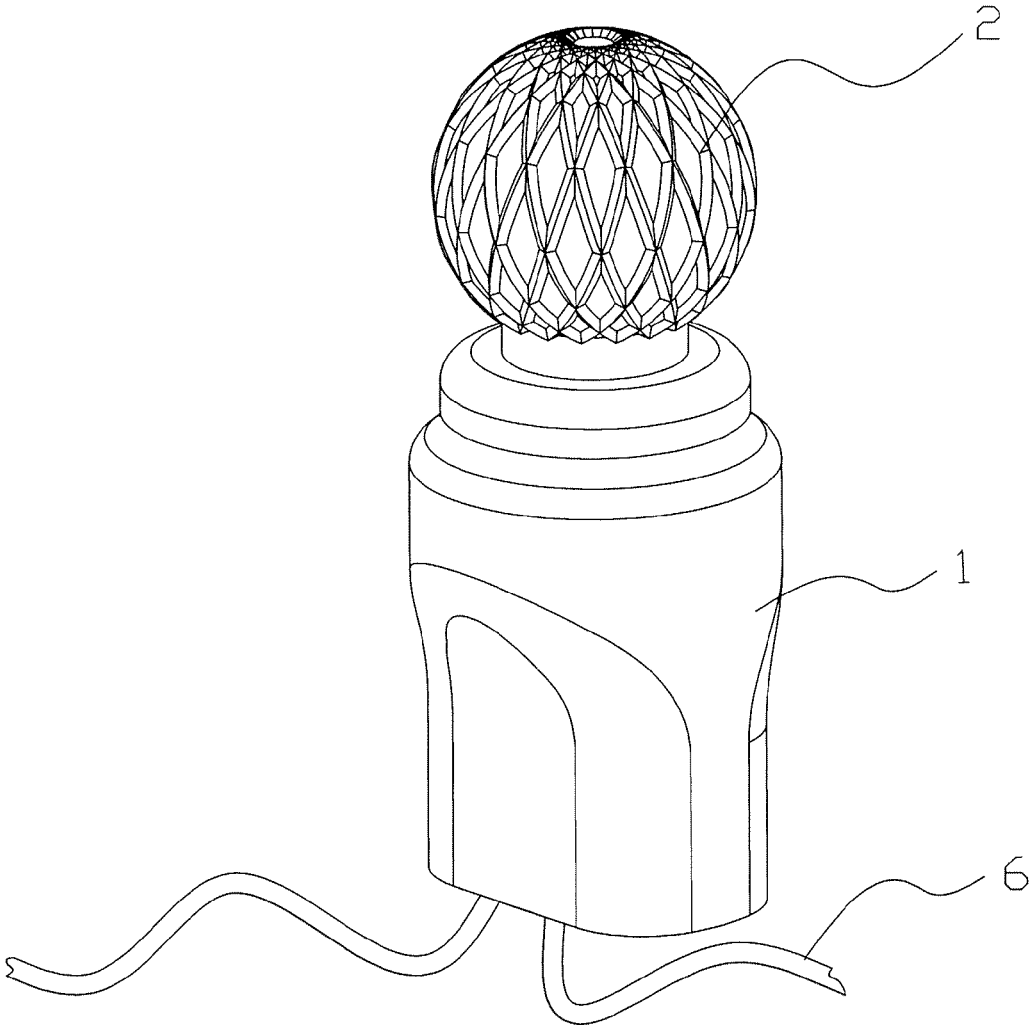
FIG. 7 is a fourth schematic view of the exterior structure of the present invention.

As shown in FIG. 3, FIG. 4 and FIG. 5, the light-emitting Chip 3 is installed on the frame 4 which comprises two leads 41 connecting the exterior power supply. The anode and cathode of the chip 3 are electrically connected to the two leads 41 by means of golden wires. The upper portion of the frame 4 encapsulated into the mantle-shaped package colloid 2 by means of injection molding. The material of the package colloid can be epoxy resin, acryl or glass. The package colloid 2 can be columnar in FIG. 2, strawberry-shaped in FIG. 3, ball-shaped in FIG. 7 or bullet-shaped in FIG. 6. The two leads 41 of the frame 4 are elicited downwards from the bottom of the package colloid 2. The wires 6 are electrically connected to the two leads 41 respectively. An insulating lamina 5 is provided between the two leads 41 to prevent the two leads 41 and the wires 6 from short circuit during the process of manufacture or usage of the present invention. A lamp holder 1 is provided beneath the package colloid 2 which covers the two leads 41 and part of the wires 6, therefore the package colloid 2, the two leads 41 and the wires 6 are formed as an integral unit.

Due to the fact that the light-emitting chip 3 is installed on the frame 4, the package colloid 2 is provided to cover the top of the frame 4, the lamp holder 1 which covers the two leads 41 and part of the wires 6 is provided beneath the package colloid 2 and forms an integral unit with the package colloid 2, two leads 41 and wires 6, it is capable of eliminating the potential problem as water inleakage at the joint between the package colloid 2 and the lamp holder 1, and the waterproof ability is greatly improved. Meanwhile, the process of assembling the package colloid 2 to the lamp holder 1 by hand can be cancelled, therefore mass production by machine can be realized efficiently.

During the encapsulating process of the package colloid 2, the connecting part 21 is formed at the bottom of package colloid 2, and during the injection molding of lamp holder 1, the connecting part 21 can be used as a adhering portion, which facilitates the joint of lamp holder 1 and package colloid 2; furthermore, for strengthening the joint of lamp holder 1 and package colloid 2, the grooves 211 on the exterior surface of the connecting part 21 can extend circumferentially around the outer surface of the connecting part 21, so that a portion of the lamp holder plunges into the grooves 211 so as to fasten the joint of them.

In addition, grooves and protrusions are formed on the exterior surface of package colloid 2 so as to make the light scattered softly; it is preferable to arrange the grooves and protrusions regularly to scatter the light more evenly.

Moreover, a heat-shrinkable tube 7 is provided to cover the electrical connection of the wires 6 and the two leads 41 so as to avoid exposing a part of wires and leads outside the lamp holder during the injection process of the lamp holder 1 when the mold is installed improperly such as displacement.

What is claimed is:

1. A lamp body comprising:

a frame;

a LED light emitting chip disposed on the frame;

a package colloid encapsulating the LED light emitting chip and at least a part of the frame;

a plurality of leads extending from a bottom of the package colloid with wires respectively electrically coupled to the leads thereby creating a connection location;

an insulating lamina disposed between the leads;

a lamp holder integrally formed with the package colloid, the leads, and at least a portion of the wires; and a heat-shrinkable tube substantially encasing the connection location, the heat-shrinkable tube being substantially integrally formed with and surrounded by the lamp holder.

2. The lamp body of claim 1, further comprising a connecting part disposed at the bottom of the package colloid, the lamp holder being integrally formed with the connecting part.

3. The lamp body of claim 2, further comprising a groove formed on the connecting part.

4. The lamp body of claim 3, wherein the groove extends circumferentially along the connecting part.

5. The lamp body of claim 1, further comprising grooves and protrusions formed on an exterior surface of the package colloid.

6. A lamp body comprising:

a frame;

a LED light emitting chip disposed on the frame;

a package colloid having a connecting part formed at a bottom of the package colloid, the package colloid encapsulating an upper portion of the frame;

a plurality of leads extending downwardly from the bottom of the package colloid with wires electrically coupled to the leads thereby creating a connection location;

an insulating lamina disposed between the leads;

an injection molded lamp holder being integrally formed with the connecting part, the package colloid, the leads and the wires to create a substantially waterproof joint; and a heat-shrinkable tube substantially encasing the connection location, the heat-shrinkable tube being substantially integrally formed with and surrounded by the lamp holder.

7. The lamp body of claim 6, further comprising a groove formed on the connecting part.

8. The lamp body of claim 7, wherein the groove extends circumferentially along the connecting part.

9. The lamp body of claim 6, further comprising grooves and protrusions formed on an exterior surface of the package colloid.

10. The lamp body of claim 9, wherein the grooves and protrusions are arranged in uniform intervals.

11. A substantially waterproof LED lamp comprising:

a LED frame having an upper portion including a LED light emitting chip disposed thereon, the upper portion and the LED light emitting chip being formed within a package colloid to establish a substantially water-proof containment of the LED light emitting chip;

two leads operably coupled to the LED light emitting chip and extending outwardly from a bottom portion of the package colloid;

two wires respectively operably coupled to the leads at a connection location and extending downward from the connection location; and a lamp holder being integrally coupled to the bottom of the package colloid, wherein the lamp holder and the frame form an integral unit and a substantially water-tight seal; and a heat-shrinkable tube substantially encasing the connection location, the heat-shrinkable tube being substantially integrally formed with and surrounded by the lamp holder.

12. The lamp of claim 11, further comprising a connecting part disposed at the bottom of the package colloid, the lamp holder being integrally formed with the connecting part.

13. The lamp of claim 12, further comprising a groove formed on the connecting part.

14. The lamp of claim 13, wherein the groove extends circumferentially along the connecting part.

15. The lamp of claim 11, further comprising grooves and protrusions formed on an exterior surface of the package colloid.

16. The lamp of claim 15, wherein the grooves and protrusions are arranged in uniform intervals.

17. A method of manufacturing a substantially water-proof LED lamp comprising:

coupling a LED light emitting chip to an upper portion of a LED frame having two depending leads;

injection molding a package colloid around the upper portion of the frame, wherein the LED is substantially encapsulated within the package colloid and the leads extend outwardly from a bottom portion of the colloid;

respectively coupling wires to each of the leads thereby creating a connection location;

disposing an insulating lamina between the leads;

encasing the connection location with a heat-shrinkable tube; and injection molding a lamp holder around the heat-shrinkable tube and to the bottom portion of the package colloid, thereby forming an integral unit between the lamp holder and package colloid.

* * * * *